United States Patent [19]

Horie et al.

[11] Patent Number: 4,594,303

[45] Date of Patent: Jun. 10, 1986

[54] ELECTROPHOTOGRAPHIC PHOTORECEPTOR

[75] Inventors: Seiji Horie, Saitama; Masayoshi Nagata, Kanagawa; Junji Nakano; Hideo Sato, both of Saitama, all of Japan

[73] Assignee: Fuji Photo Film Co., Ltd., Kanagawa, Japan

[21] Appl. No.: 769,779

[22] Filed: Aug. 28, 1985

Related U.S. Application Data

[63] Continuation of Ser. No. 628,135, Jul. 11, 1984, abandoned, which is a continuation of Ser. No. 398,488, Jul. 15, 1982, abandoned.

[30] Foreign Application Priority Data

Jul. 15, 1981 [JP] Japan ..... 56-110423

[51] Int. Cl.[4] ..... G03G 5/06; G03G 5/14

[52] U.S. Cl. ..... 430/59; 430/58; 430/70; 430/73; 430/74; 430/75; 430/76; 430/77; 430/78; 430/79

[58] Field of Search ..... 430/58, 59, 70, 73, 430/74, 75, 76, 77, 78, 79

[56] References Cited

U.S. PATENT DOCUMENTS

| | | | |
|---|---|---|---|
| 3,246,983 | 4/1966 | Sus et al. | 430/73 X |
| 3,719,480 | 3/1973 | Brantly | 430/77 |
| 4,293,626 | 10/1981 | Webster et al. | 430/74 X |
| 4,407,919 | 10/1983 | Murayama et al. | 430/58 |

FOREIGN PATENT DOCUMENTS

| | | | |
|---|---|---|---|
| 3117701 | 1/1982 | Fed. Rep. of Germany | 430/77 |
| 7503582 | 7/1975 | Netherlands | 430/70 |
| 1337228 | 11/1973 | United Kingdom | 430/58 |

*Primary Examiner*—Roland E. Martin

*Attorney, Agent, or Firm*—Sughrue, Mion, Zinn, Macpeak & Seas

[57] ABSTRACT

An electrophotographic photoreceptor which has an electrophotographic photoreceptive layer containing as a charge generating material a particular organic compound having the general formula described hereinafter in this disclosure in a combination with a charge transporting material. The compounds improve upon the sensitivity, durability and selectivity to photosensitive wavelengths of photoreceptors. Furthermore, the photoreceptors can be easily manufactured.

22 Claims, 3 Drawing Figures

ELECTROPHOTOGRAPHIC PHOTORECEPTOR

This is a continuation of application Ser. No. 628,135, filed July 11, 1984, now abandoned, which is a continuation of U.S. Ser. No. 398,488, filed July 15, 1982, now abandoned.

FIELD OF THE INVENTION

The present invention relates to an electrophotographic photoreceptor containing a charge generating material and a charge transporting material. More particularly, the invention relates to an electrophotographic photoreceptor which contains as a charge generating material a particular compound represented by the general formula (I) or (II) described hereinafter in its photoreceptive layer formed on a conductive support.

BACKGROUND OF THE INVENTION

In general, a photoconduction process which utilizes an electrophotographic photoreceptor, comprises the steps of:

(1) generating electric charges by light-exposure; and (2) transporting the electric charges.

Photoreceptors can be divided into a group in which the steps (1) and (2) above are performed by the same substance, and a group in which they are performed by different substances. A typical example of the former group is a selenium photoreceptive plate. For the latter group, a combination of amorphous selenium and poly-N-vinyl carbazole is well known. Photoreceptors falling within the latter group having advantages in that a wide range of starting materials can be used in the preparation of the photoreceptors. This may make it possible to increase electrophotographic characteristics such as the sensitivity of photoreceptor and receiving potential, and in that substances suitable for increasing these characteristics can be chosen from a wide range.

Photoconductive materials which have heretofore been used in photoreceptors to be used according to the electrophotographic system include inorganic substances such as selenium, cadmium sulfide, and zinc oxide.

The electrophotographic process disclosed by Carlson in U.S. Pat. No. 2,297,691, uses a photoconductive material comprising a support coated with a substance which is insulative in a dark place and changes its electric resistance depending on the amount of light irradiated during imagewise exposure. In general, the photoconductive material, after being subjected to dark conditioning for a suitable period of time, is uniformly provided with electric charges on the surface thereof in a dark place. Thereafter, the material is exposed imagewise according to a pattern of irradiation having the effect of reducing surface electric charges depending on the relative energy contained in various parts of the pattern. The surface electric charges thus allowed to remain on the photoconductive substance layer (photoreceptive layer), i.e., an electrostatic latent image, is converted into a visible image by bringing the photoconductive substance layer into contact with suitable charge-detecting and -developing substances, i.e., toners.

These toners can be drawn to the surface of the light-sensitive layer according to an electric charge pattern even though they are contained in an insulative liquid or in dry carriers. The thus-drawn toners can be fixed by known techniques such as application of heat, pressure or solvent vapor. Furthermore, the electrostatic latent image can be transferred to a second support. Similarly, the electrostatic latent image can be transferred to a second support (e.g., paper and a film) where it is developed.

Electrophotographic process is one of image forming processes to form images according to the above processes.

Some of the fundamental characteristics required for the photoreceptor for use in the electrophotographic process are:

(1) It can be charged at a suitable potential in a dark place;

(2) Little or no dissipation of electric charges occurs in a dark place; and (3) Irradiation with light permits rapid dissipation of electric charges.

The above described inorganic substances which have heretofore been used as photoconductive materials suffer from various disadvantages although they have many advantages. For example, selenium that is presently in widespread use sufficiently meets the above requirements (1) to (3). However, use of this material is not desirable because production conditions are severe, production costs are high, flexibility is poor, it is difficult to shape into a belt-like form. Furthermore, care must be taken in handling since it is of low resistance against heat or mechanical impact. Cadmium sulfide and zinc oxide are used as light-sensitive materials in which they are dispersed in resins as binders. However, they cannot be used repeatedly as such since they are inferior in mechanical properties such as smoothness, hardness, tensile strength, and frictional resistance.

In recent years, to remove the above described defects of the inorganic substances, electrophotographic photoreceptors prepared using various organic substances have been proposed, and some of the photoreceptors have been put into practical use. Examples include a photoreceptor containing poly-N-vinyl carbazole and 2,4,7-trinitrofluorene-9-on as described in U.S. Pat. No. 3,484,237, a photoreceptor containing poly-N-vinyl carbazole which is sensitized with pyrylium salt-based dye, as described in Japanese Patent Publication No. 25658/73, a photoreceptor containing organic pigment as a major component as described in Japanese Patent Application (OPI) No. 37543/72 (the term "OPI" is used herein to refer to a "published unexamined Japanese Patent application"), and a photoreceptor containing an eutectic complex of a dye and a resin, as described in Japanese Patent Application (OPI) No. 10735/72. These photoreceptors are believed to have excellent characteristics and to be of high practical value. In practice, however, no photoreceptor sufficiently satisfies all the requirements for a photoreceptor, e.g., convenient to produce, exhibits satisfactory electrophotographic characteristics, and a good wavelength selectivity which is required when the light-sensitive material is used as a laser beam printer or a display element.

The present inventor began experiments in order to develop photoreceptors which could satisfy all the requirements to the fullest possible extent. As a result of these efforts the present inventors have developed what they believe to be and improved electrophotographic photoreceptor which is described below.

SUMMARY OF THE INVENTION

As a result of examining various charge generating materials, it has now been found that compounds which can be represented by the general formula (I) or (II) described hereinafter are excellent as charge generating materials. Furthermore, these compounds fully satisfy various requirements for electrophotographic photoreceptors thus achieveing the present invention.

Merocyanine dyes are well known as spectral sensitizing dyes, and a number of investigations have been undertaken in this area.

The compounds employed in the present invention are not themselves novel compounds. Japanese Patent Application (OPI) Nos. 21086/80, 34832/79 and 24024/79 disclose that these compounds are used as electrophotographic photosensitive materials, especially electrically photosensitive particles in the electrophoretic image forming process. However, these compounds have never been considered as being photoconductive substances. It has been believed that such compounds were effective only when used as electrically photosensitive particles for the electrophoretic image forming process.

We have now found that these compounds possess excellent properties as a charge generating material. We have also found that photoreceptors comprised of combinations of these compounds and charge transporting materials exhibit high sensitivity, are excellent in durability and have useful photoconductive characteristics.

The present inventors have also found that the wavelength selectivity required upon the application of these electrophotographic photoreceptors to a laser beam printer or display element is good. It is also possible to disperse these charge generating materials in charge transporting materials homogeneously and therethrough, photoreceptors excellent in transparency can be obtained.

The present invention comprises:

(1) an electrophotographic photoreceptor which has an electrophotographic photoreceptive layer containing a charge generating material and a charge transporting material, the charge generating material being represented by the following general formula (I) or (II):

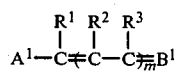

(I)

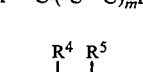

(II)

wherein;

(i) m represents 0 or 1, and n represents 0, 1 or 2, (ii) $R^1$ to $R^5$ may be the same or different, and each represents a hydrogen atom, an alkyl group, an aralkyl group, an aryl group or a monovalent group produced by removing one hydrogen atom from a heterocyclic ring, (iii) $A^1$ represents a substituted phenyl group or a monovalent group produced by removing one hydrogen atom from a monocyclic 5-membered ring, a condensed 5-membered hetero-ring or a condensed 6-membered hetero-ring, which are represented by the following structural formulae, respectively;

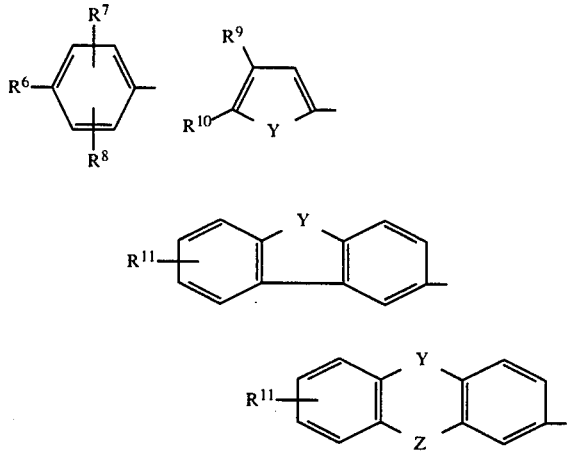

wherein $R^6$ represents an alkoxy group, an aralkyloxy group or a substituted amino group represented by

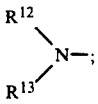

$R^{12}$ and $R^{13}$ each represents a substituted or non-substituted alkyl group or a substituted or non-substituted phenyl group, or they may combine with each other and form a nitrogen-containing hetero-ring, and they may be the same or different; $R^7$ and $R^8$ may be the same or different, and each represents a hydrogen atom, a halogen atom, an alkyl group or a lower alkoxy group; Y and Z represent S, O or N—$R^{14}$ (wherein $R^{14}$ represents an alkyl group having 1 to 4 carbon atoms), and they may be the same or different atoms; $R^9$ and $R^{10}$ may be the same or different, and each represents a hydrogen atom, an alkyl group or an alkoxy group, or they may combine with each other and form a benzene ring or a naphthalene ring; and $R^{11}$ represents a hydrogen atom, an alkyl group, an alkoxy group, an aryloxy group, an acyl group, an alkoxycarbonyl group, aryloxycarbonyl group, a halogen atom, a monoalkylamino group, a dialkylamino group, an amido group or a nitro group, which groups each may have some substituents or not;

(iv) $A^2$ represents a divalent group produced by removing two hydrogen atoms attached to the same carbon from the ring of a heterocyclic compound selected from a group consisting of imidazoles, 3H-indoles, thiazoles, benzothiazoles, naphthothiazoles, thianaphthenoT',6',4,5-thiazoles, oxazoles, benzoxazoles, naphthoxazoles, selenazoles, benzoselenazoles, naphthoselenazoles, thiazolines, quinolines, isoquinolines, benzimidazoles and pyridines, and (v) $B^1$ represents a divalent group selected from substituents represented by the following structural formulae;

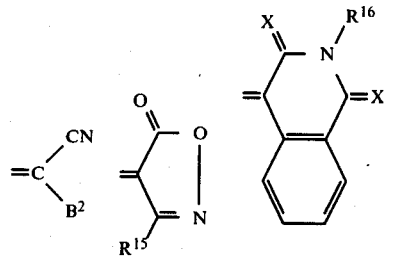

wherein $R^{15}$ and $R^{16}$ each represents an alkyl group or an aryl group; X represents an oxygen atom or a sulfur atom; and $B^2$ represents a cyano group, a carboxyl group, an alkoxycarbonyl group, an aryloxycarbonyl group, an alkylsulfonyl group, an alkylcarbonyl group, an arylcarbonyl group, a nitro group, a nitro-substituted aryl group, a sulfo group, a trifluoromethylsulfonyl group, a carbamoyl group, an alkylcarbamoyl group, an arylcarbamoyl group or an acyl group whose carbonyl group is attached to a monovalent group produced by removing one hydrogen atom from a heterocyclic ring;

(2) the electrophotographic photoreceptor described in (1) which comprises of the above-described electrophotographic photoreceptive layer containing the above-described charge generating material and the above-described charge transporting material, with the electrophotographic photoreceptive layer having a single layer form; and (3) the electrophotographic photoreceptor described in (1) which comprised of the above-described electrophotographic photoreceptive layer constructed by two layers, one layer being a charge generating layer containing the above-described charge generating material, and the other layer being a charge transporting layer containing the above-described charge transporting material.

DETAILED DESCRIPTION OF THE INVENTION

Figure 1:
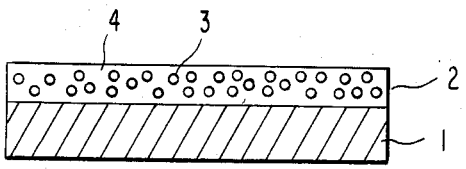
FIGS. 1 to 3 are schematic cross-sectional views of the electrophotographic photoreceptors prepared in accordance with the embodiments of the present invention, which are enlarged in their respective thickness directions. Therein, numeral 1 designates a conductive support, numeral 2 an electrophotographic photoreceptive layer, numeral 3 a charge generating material, numeral 4 a charge transfer layer, and numeral 5 a charge generating layer.

Compounds represented by the general formula (I) or (II) are illustrated in detail below.

Substituents $R^1$, $R^2$, $R^3$, $R^4$ and $R^5$ in the compounds of the present invention represented by the above-described general formula (I) or (II) include a hydrogen atom; as alkyl groups having 1 to 12 carbon atoms a methyl group, an ethyl group, a butyl group and octyl group; as aralkyl groups a benzyl group and a phenethyl group; as aryl groups a phenyl group and a naphthyl group; and as monovalent groups produced by removing one hydrogen atom from the ring of a heterocyclic compound (which is called a heterocyclyl group, hereinafter), a 2-thienyl group and a 2-furyl group.

Substituted phenyl groups represented by $A^1$, which have the general formula

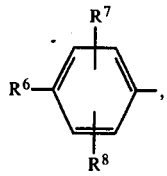

are described in more detail;

Alkoxy groups or aralkyloxy groups represented by $R^6$ are those which contain 1 to 12 carbon atoms in their individual groups, with specific examples including a methoxy group, an ethoxy group, a propoxy group, a butoxy group, an octyloxy group and a benzyloxy group.

In the case that $R^6$ is represented by a substituted amino group represented by

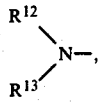

$R^{12}$ and $R^{13}$ each includes non-substituted alkyl groups having 1 to 12 carbon atoms, such as methyl, ethyl, propyl, butyl and the like, and alkyl groups having the following substituents and that, containing 1 to 12 carbon atoms.

Substituents which the alkyl groups represented by $R^{12}$ and $R^{13}$ may have include alkoxy groups containing 1 to 4 carbon atoms, aryloxy groups containing 6 to 12 carbon atoms, hydroxy group, aryl groups containing 6 to 12 carbon atoms, cyano group and halogen atoms. Preferable examples of substituted alkyl groups represented by $R^{12}$ and $R^{13}$ include (a) alkoxyalkyl groups such as methoxymethyl, methoxyethyl, ethoxymethyl, ethoxyethyl, ethoxypropyl, methoxybutyl, propoxymethyl, etc.; (b) aryloxyalkyl groups such as phenoxymethyl, phenoxyethyl, naphthoxymethyl, phenoxypentyl, etc.; (c) hydroxyalkyl groups such as hydroxymethyl, hydroxyethyl, hydroxypropyl, hydroxyoctyl, etc.; (d) aralkyl groups such as benzyl, phenethyl, ω,ω-diphenylalkyl, etc.; (e) cyanoalkyl groups such as cyanomethyl, cyanoethyl, cyanopropyl, cyanobutyl, cyanooctyl, etc.; and (f) haloalkyl groups such as chloromethyl, bromomethyl, chloroethyl, bromopentyl, chlorooctyl, etc.

In case that $R^{12}$ and $R^{13}$ represent phenyl groups, the phenyl group may have a certain substituent. As examples of such a substituent, mention may be made of (a) alkyl groups containing 1 to 12 carbon atoms, (b) alkoxy groups containing 1 to 4 carbon atoms, (c) aryloxy groups containing 6 to 7 carbon atoms, (d) acyl groups containing 2 to 8 carbon atoms, (e) alkoxycarbonyl groups having 2 to 5 carbon atoms, (f) halogen atoms, (g) monoalkylamino groups having 1 to 4 carbon atoms, (h) dialkylamino group whose alkyl moieties having 1 to 4 carbon atoms, (i) amino groups having 2 to 4 carbon atoms and (j) nitro group. Specifically, (a) alkyl groups containing 1 to 12 carbon atoms are e.g., methyl group, ethyl group, straight or branched chain propyl group, butyl group, pentyl group, hexyl group and the like, (b) alkoxy groups having 1 to 4 carbon atoms are e.g., methoxy group, ethoxy group, propoxy group and butoxy group, (c) aryloxy groups are e.g., phenoxy group and o-, m- or p-tolyloxy group, (d) acyl groups are e.g., acetyl group, propionyl group, benzoyl group and o-, m- or p-toluoyl group, (e) alkoxycarbonyl groups having 2 to 5 carbon atoms are e.g., methoxycarbonyl, ethoxycarbonyl, propoxycarbonyl and butoxycarbonyl, (f) halogen atoms are e.g., chlorine atom, bromine atom and fluorine atom, (g) monoalkylamino groups whose alkyl moieties have 1 to 4 carbon atoms are e.g., methylamino group, ethylamino group and butylamino group, (h) dialkylamino groups whose alkyl moieties have 1 to 4 carbon atoms are e.g., dimethylamino group, diethylamino group, dipropylamino group, dibutylamino group and N-methyl-N-ethylamino group, and (i) amido groups are e.g., acetoamido group and propionamido group.

In the case that $R^{12}$ and $R^{13}$ combine with each other and form a hetero-ring, hetero-rings represented by the following structural formulae are preferable;

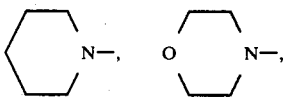

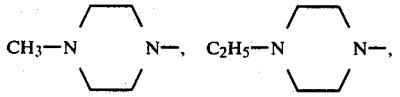

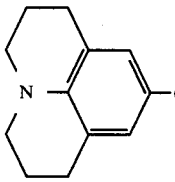

(which group corresponds to

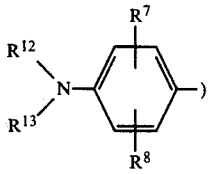

Preferable substituents as $R^6$ are substituted amino groups, especially those which contain as $R^{12}$ and/or $R^{13}$ methyl group, ethyl group, benzyl group, phenyl group or tolyl group. In particular, dimethylamino group, diethylamino group, dibenzylamino group, diphenylamino group, N-ethyl-N-phenylamino group and like di-substituted amino groups are preferable.

Substituents $R^7$ and $R^8$ in the moiety $A^1$ include hydrogen atom; halogen atoms such as chlorine, bromine, fluorine, etc.; alkyl groups having 1 to 4 carbon atoms such as methyl, ethyl, propyl, butyl, etc.; alkoxy groups having 1 to 4 carbon atoms such as methoxy, ethoxy, propoxy, butoxy, etc.; and so on. Of these groups, a hydrogen atom, methyl group and methoxy group are more preferable.

In the monovalent group represented by $A^1$, which is produced by removing one hydrogen atom from a monocyclic or a condensed heterocyclic 5-membered ring, or a condensed heterocyclic 6-membered ring, Y and Z each represents S, O or N—$R^{14}$ (where $R^{14}$ represents an alkyl group containing 1 to 4 carbon atoms), and they may be the same or different.

Specific examples of $R^{14}$ include methyl group, ethyl group, propyl group, butyl group, isopropyl group and isobutyl group.

Substituents $R^9$ and $R^{10}$ in the heterocyclic 5-membered ring represented by $A^1$ include a hydrogen atom; alkyl groups having 1 to 4 carbon atoms such as methyl, ethyl, propyl, butyl, etc.; alkoxy groups having 1 to 4 carbon atoms such as methoxy, ethoxy, propoxy, butoxy, etc.; and atoms capable of forming a benzene ring or a naphthalene ring when they combine with each other.

Substituent $R^{11}$ in the condensed heterocyclic residue represented by $A^1$ include a hydrogen atom, the same substituted or non-substituted alkyl groups as in the above described substituted or non-substituted alkyl groups $R^{12}$ and $R^{13}$, alkoxy groups having 1 to 4 carbon atoms, aryloxy groups having 6 to 10 carbon atoms, acyl groups having 2 to 11 carbon atoms, alkoxycarbonyl groups having 2 to 5 carbon atoms, aryloxycarbonyl having 7 to 11 carbon atoms, monoalkylamino group having 1 to 4 carbon atoms, dialkylamino groups having 1 to 4 carbon atoms, amido groups having 2 to 9 carbon atoms, nitro group, etc. Each of these groups may have some substituent or not.

More specifically, the alkoxy groups having 1 to 4 carbon atoms are e.g., methoxy group, ethoxy group, propoxy group and butoxy group; the aryloxy groups are e.g., phenoxy group, and o-, m- or p-tolyloxy group; the acyl groups are e.g., acetyl group, propionyl group, benzoyl group, and o-, m- or p-toluoyl group; the alkoxycarbonyl groups having 2 to 5 carbon atoms are e.g., methoxycarbonyl group, ethoxycarbonyl group, propoxycarbonyl group and butoxycarbonyl group; the aryloxycarbonyl groups having 7 to 11 carbon atoms are e.g., phenoxycarbonyl group, and o-, m- or p-tolyloxycarbonyl group; the halogen atoms are e.g., chlorine atom, bromine atom, and fluorine atom; the monoalkylamino groups whose alkyl moieties have 1 to 4 carbon atoms are e.g., methylamino group, ethylamino group, and butylamino group; the dialkylamino groups whose alkyl moieties have 1 to 4 carbon atoms are e.g., dimethylamino group, diethylamino group, dipropylamino group, dibutylamino group, and N-methyl-N-ethylamino group; the amido groups are e.g., acetoamido group, and propionamido group; and nitro groups.

Specific examples of the monovalent group produced by removing one hydrogen atom from the heterocyclic 5-membered ring represented by $A^1$ include 2-furyl group, 2-thienyl group, 1-methyl-2-pyrrolyl group, and 5-methyl-2-thienyl group; specific examples of the monovalent group produced by removing one hydrogen atom from the condensed heterocyclic 5-membered ring represented by $A^1$ include 2-benzo[b]thienyl group, 2-naphtho[2,3-b]thienyl group, 9-ethylcarbazole-2-yl group, and dibenzothiophene-2-yl group; and specific examples of the monovalent group produced by removing one hydrogen atom from the condensed heterocyclic 6-membered ring represented by $A^1$ include 2-phenoxathiinyl group, 10-ethylphenoxazine-3-yl group and 10-ethylphenothiazine-3-yl group whose structural formulae are illustrated below:

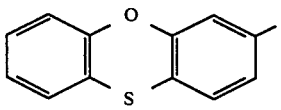

-continued

2-Phenoxathiinyl group

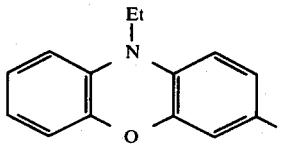

10-Ethylphenoxazine-3-yl group

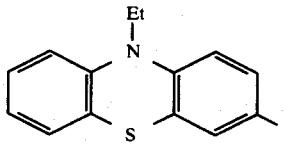

10-Ethylphenothiazine-3-yl group

Preferable monovalent groups of the above-described ones are 5-methyl-2-thienyl group, 2-benzo[6]thienyl group, 9-ethylcarbazole-2-yl group, dibenzothiophene-2-yl group and 10-ethylphenothiazine-3-yl group.

The moiety $A^2$ represents a divalent group produced by removing two hydrogen atoms attached to the same atoms from the ring of a heterocyclic compound selected from a group comprising of the following ones (which divalent group is called a heterocyclylidene group):

(a) imidazoles, such as 4-phenylimidazole, 4-phenyl-3-ethyl-2,3-dihydroimidazole, 1,3-dimethyl-2,3-dihydroimidazole, and 1,3-diethyl-2,3-dihydroimidazole;

(b) 3H-indoles, such as 3H-indole, 3,3-dimethyl-3H-indole, 1,3,3-trimethyl-3H-indole, 1-ethyl-3,3-dimethyl-3H-indole, 1-butyl-3,3-dimethyl-3H-indole, 5-methoxy-1,3,3-trimethyl-3H-indole, 5-ethoxycarbonyl-1-ethyl-3,3-dimethyl-3H-indole, and 3,3,5-trimethyl-3H-indole;

(c) thiazoles, such as thiazole, 4-methylthiazole, 4-phenylthiazole, 5-methylthiazole, 5-phenylthiazole, 4,5-dimethylthiazole, 4,5-diphenylthiazole, 4-(2-thienyl)-thiazole, 3-methyl-2,3-dihydrothiazole, and 3-ethyl-2,3-dihydrothiazole;

(d) benzothiazoles, such as benzothiazole, 4-chlorobenzothiazole, 5-chloro-benzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-methylenedioxybenzothiazole, 6-hydroxybenzothiazole, 3-methyl-2,3-dihydrobenzothiazole, and 3-ethyl-2,3-dihydrobenzothiazole;

(e) naphthothiazoles, such as naphtho[1,2-d]thiazole, naphtho[2,1-d]thiazole, naphtho[2,3-b]thiazole, 5-methoxynaphtho[2,1-d]thiazole, 5-ethoxynaphtho[2,1-d]thiazole, 8-methoxynaphtho[1,2-d]thiazole, 7-methoxynaphtho[1,2-d]thiazole, 3-methyl-2,3-dihydronaphtho[1,2-d]thiazole, and 3-ethyl-2,3-dihydronaphtho[1,2-d]thiazole;

(f) thianaphtheno[7,6-d]thiazoles, such as 5-methoxythianaphtheno[7,6-d]thiazole, 1-methyl-1,2-dihydrothianaphtheno[7,6-d]thiazole, and 1-ethyl-1,2-dihydrothianaphtheno[7,6-d]thiazole;

(g) oxazoles, such as 4-methyloxazole, 5-methyloxazole, 4-phenyloxazole, 4,5-diphenyloxazole, 4-ethyloxazole, 4,5-dimethyloxazole, 5-phenyloxazole, 3-methyl-2,3-dihydrooxazole, and 3-ethyl-2,3-dihydrooxazole;

(h) benzoxazoles, such as benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 5-chlorobenzoxazole, 6-methoxybenzoxazole, 5-hydroxybenzoxazole, 6-hydroxybenzoxazole, 3-methyl-2,3-dihydroxybenzoxazole, and 3-ethyl-2,3-dihydrobenzoxazole;

(i) naphthoxazoles, such as naphtho[1,2-d]oxazole, naphtho [2,1-d]oxazole, 1-methyl-1,2-dihydronaphtho[1,2-d]oxazole, and 3-ethyl-2,3-dihydronaphtho[2,1-d]oxazole;

(j) selenazoles, such as 4-methylselenazole, 4-phenylselenazole, 3-methyl-2,3-dihydroselenazole, and 3-ethyl-2,3-dihydroselenazole;

(k) benzoselenazoles, such as benzoselenazole, 5-chlorobenzoselenazole, 5-methoxybenzoselenazole, 5-hydrobenzoselenazole, 4,5,6,7-tetrahydrobenzoselenazole, 3-methyl-2,3-dihydrobenzoselenazole, and 3-ethyl-2,3-dihydrobenzoselenazole;

(l) naphthoselenazoles, such as naphtho[1,2-d]selenazole, naphtho[2,1-d]selenazole, 1-ethyl-1,2-dihydro[1,2-d]selenazole, and 3-methyl-2,3-dihydronaphtho[2,1-d]selenazole;

(m) thiazolines, such as 2-thiazoline, 4-thiazoline, 3-methyl-4-thiazoline, and 3-ethyl-4-thiazoline;

(n) quinolines, such as quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, 1-methyl-1,2-dihydroquinoline, 1-ethyl-1,2-dihydroquinoline, 1-methyl-1,4-dihydroquinoline, and 1-ethyl-1,4-dihydroquinoline;

(o) isoquinolines, such as isoquinoline, 3,4-dihydroisoquinoline, 2-methyl-1,2-dihydroisoquinoline, and 2-ethyl-1,2-dihydroisoquinoline;

(p) benzimidazoles, such as 1,3-dimethyl-2,3-dihydrobenzimidazole, 1,3-diethyl-2,3-dihydrobenzimidazole, and 1-ethyl-3-phenyl-2,3-dihydrobenzimidazole; and (q) pyridines, such as pyridine, 5-methylpyridine, 1-methyl-1,2-dihydropyridine, 1-ethyl-1,2-dihydropyridine, 1-methyl-1,4-dihydropyridine, and 1-ethyl-1,4-dihydropyridine.

Heterocyclylidene groups derived from the above described heterocyclic compounds are divalent groups which are all well known in cyanine dyes and merocyanine dyes.

Specific examples of the heterocyclylidene groups include 3H-indole-2-ylidene group, 1,3,3-trimethyl-3H-indole-2-ylidene group, 1-ethyl-3,3-dimethyl-3H-indole-2-ylidene group, thiazoline-2-ylidene group, 3-methylthiazoline-2-ylidene group, 3-ethylthiazoline-2-ylidene group, 3-methyl-2,3-dihydrooxazole-2-ylidene group, 3-ethyl-2,3-dihydrooxazole-2-ylidene group, 2,3-dihydrobenzothiazole-2-ylidene group, 3-methyl-2,3-dihydrobenzothiazole-2-ylidene group, and 3-ethyl-2,3-dihydrobenzothiazole-2-ylidene group.

Specific examples of the substituent $B^2$ include cyano group; carboxyl group; alkoxycarbonyl groups having 2 to 5 carbon atoms, such as methoxycarbonyl group, ethoxycarbonyl group, propoxycarbonyl group and butoxycarbonyl; aryloxycarbonyl groups such as phenoxycarbonyl group, o-, m- or p-tolyloxycarbonyl group, 1-naphthoxycarbonyl group, and 2-naphthoxycarbonyl group; alkylsulfonyl groups having 1 to 8 carbon atoms such as methylsulfonyl group, ethylsulfonyl group, butylsulfonyl group and octylsulfonyl group; alkylcarbonyl groups such as acetyl group and propionyl group; arylcarbonyl groups such as benzoyl group, and o-, m- or p-toluoyl group; nitro group; nitro-substituted aryl groups such as o-, m- and p-nitrophenyl groups, and 2,4-dinitrophenyl group; sulfo group; trifluoromethylsulfonyl group; carbamoyl group; arylcarbamoyl groups such as phenylcarbamoyl group, and o-, m- and p-tolylcarbamoyl groups; alkylcarbamoyl groups whose alkyl moieties have 1 to 8 carbon atoms, such as methylcarbamoyl group, ethylcarbamoyl group, butylcarbamoyl group and octylcarbamoyl group; and heterocyclylcarbonyl groups such as 2-furoyl group, 3-furoyl group, 2-thenoyl group, nicotinoyl group and isonicotinoyl group.

The alkyl groups represented by substituents $R^{15}$ and $R^{16}$ are those having 1 to 12 carbon atoms, such as methyl group, ethyl group, butyl group and octyl group, and the aryl groups represented by such substituents are a phenyl group and a naphthyl group which each may have such substituents as described in the substituted phenyl groups represented by $R^{12}$.

Specific examples of the compound represented by the general formula (I) or (II) are illustrated below. Therein, Me represents methyl group, and Et represents ethyl group.

(1)

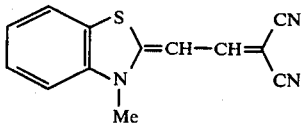

(2)

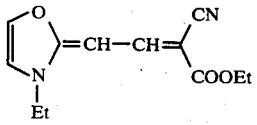

(3)

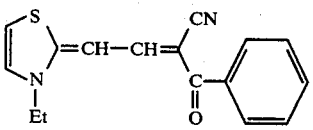

(4)

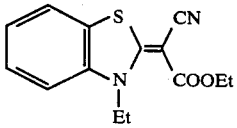

(5)

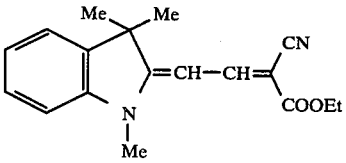

(6)

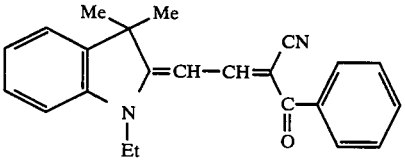

-continued (7)

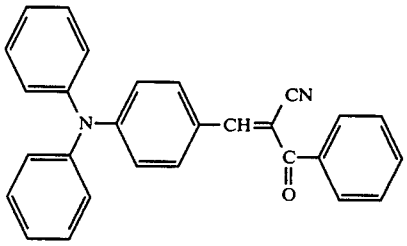

(8)

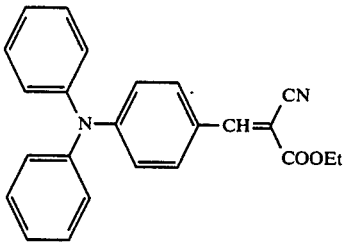

(9)

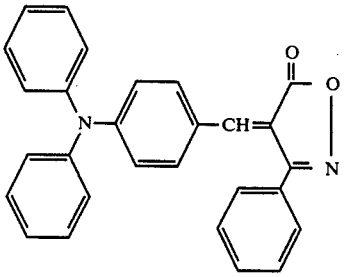

(10)

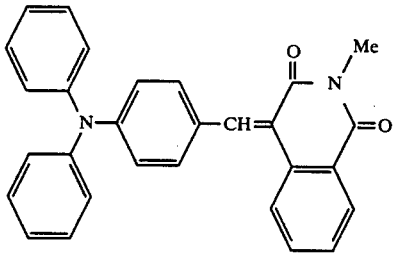

(11)

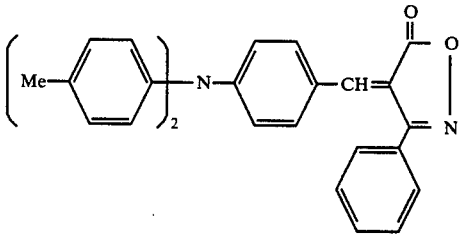

(12)

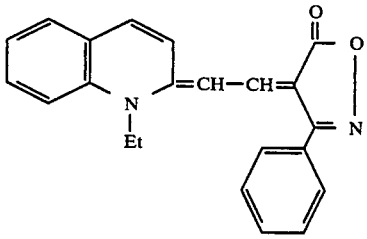

-continued
(13)
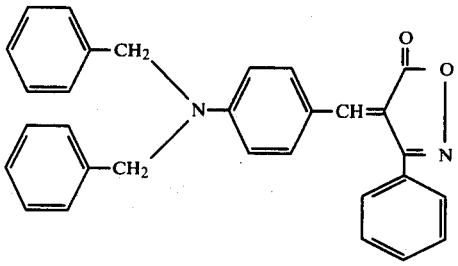
(14)
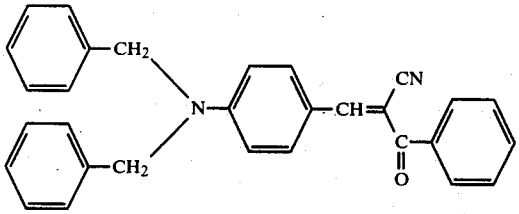
(15)
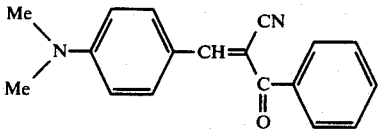
(16)
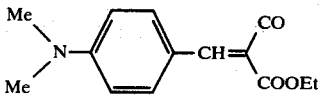
(17)
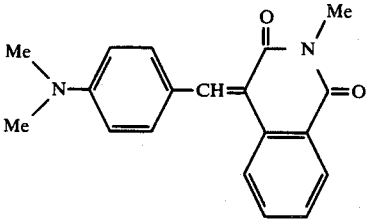
(18)
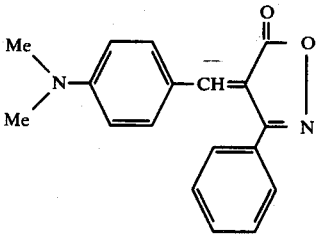
(19)
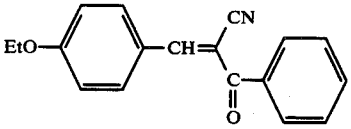
(20)
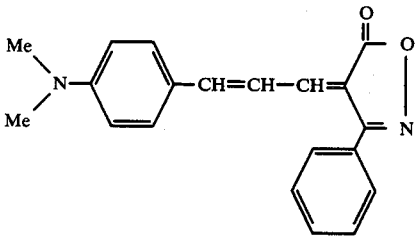
-continued
(21)
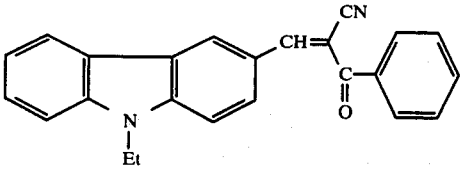
(22)
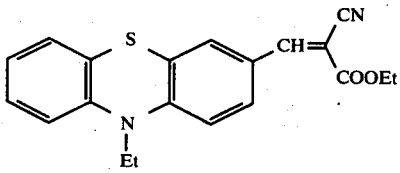
(23)
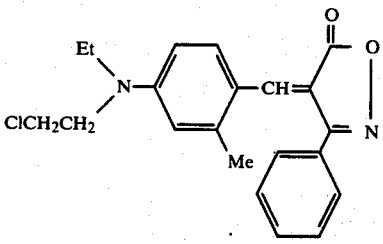
(24)
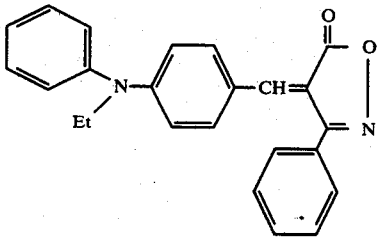
(25)
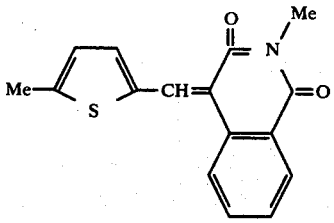
(26)
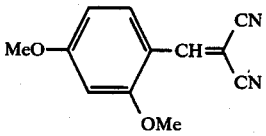
(27)
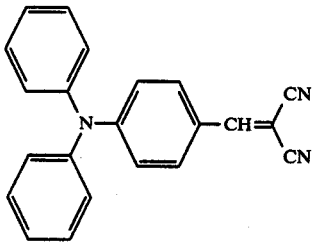
(28)
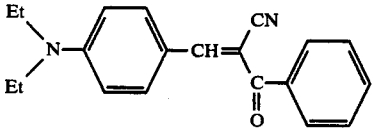

-continued (29)

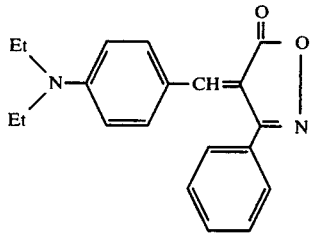

(30)

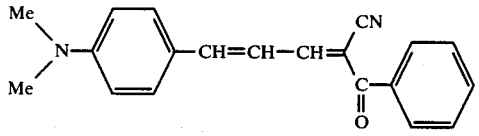

(31)

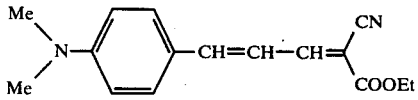

(32)

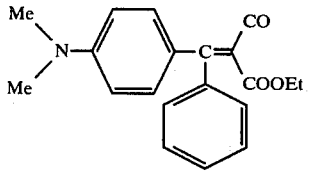

(33)

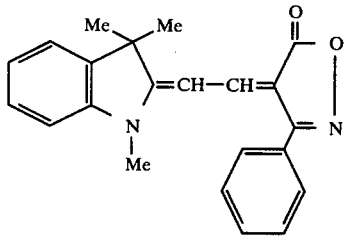

The compounds represented by the general formula (I) or (II) can be produced using the methods described in *J. Am. Chem. Soc.*, vol. 35, p. 959 (1913), *J. Am. Chem. Soc.*, vol. 73, p. 5326 (1951), and U.S. Pat. Nos. 2,538,009, 2,721,799, 2,860,981, 2,860,982, 2,165,339, 2,956,881, 2,328,652 and 3,743,638.

An electrophotographic photoreceptor of the present invention employs the compound represented by the general formula (I) or (II) as a charge generating material and uses it in a combination with a charge transporting material. According to the way of applying this compound to an electrophotographic photoreceptor, such embodiments as illustrated in FIGS. 1 to 3 can be adopted.

The photoreceptor of FIG. 1 has on a conductive support, at least the surface of which is conductive, an electrophotographic photoreceptive layer wherein the compound 3 is a charge generating material represented by the general formula (I) or (II) which is dispersed homogeneously or heterogeneously into a charge transporting medium 4 constituted with a charge transporting material and a binder.

Figure 2:
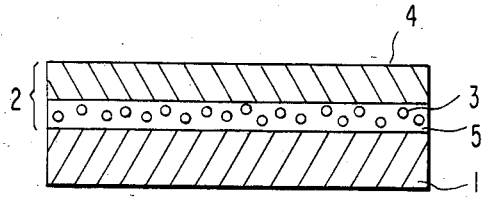

The photoreceptor of FIG. 2 is comprised of a support at least the surface of which is conductive; an electrophotographic photoreceptive layer 2 comprised of a charge generating layer 5 containing as a major component the compound 3 represented by the general formula (I) or (II) (which compound may be dispersed therein homogeneously, or heterogeneously); and a charge transporting layer 4 containing a charge transporting material.

Figure 3:
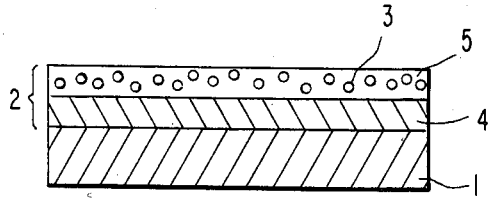

The photoreceptor of FIG. 3 is comprised of a support at least surface of which is conductive; an electrophotographic photoreceptive layer 2 prepared by providing a charge transporting layer 4 containing a charge transporting material on the conductive support and further thereon, providing a charge generating layer 5 containing as a major component the compound 3 represented by the general formula (I) or (II) (which compound may be dispersed therein homogeneously, or heterogeneously).

The photoreceptor of FIG. 1 is prepared by dissolving or dispersing the compound represented by the general formula (I) or (II) in a solution of a charge transporting material and a binder. The resulting solution or dispersion is then coated onto a conductive support. Then drying is carried out to form an electrophotographic photoreceptive layer.

The photoreceptor of FIG. 2 is prepared by forming on a conductive support a layer of the charge generating compound represented by the general formula (I) or (II) using the vacuum deposition technique, or by coating on a conductive support a dispersion prepared by dispersing the compound represented by the general formula (I) or (II) in an appropriate solvent in which a binder is optionally dissolved, and drying the coated dispersion. Further, if necessary, it is submitted to a surface finishing treatment, e.g., polishing the surface with a buff, or adjusting the thickness of the coat to a proper one. Then a solution containing a charge transporting material and a binder is coated on the layer of charge generating material and dried. This type of coating is carried out using conventional means, e.g., doctor blade, wire bar or so on.

The photoreceptor of FIG. 3 is prepared by coating on a conductive support a solution containing a charge transporting material and a binder with a conventional means. The coating is then dried to form a charge transporting layer and subsequently, provided with a charge generating layer in the same manner as in the photoreceptor of FIG. 2.

The thickness of the electrophotographic photoreceptive layer of FIG. 1 is 3 μm to 50 μm, and preferably 5 μm to 20 μm. The thickness of the charge generating layer of FIGS. 2 and 3 each is 5 μm or less, and preferably 2 μm or less, and that of the charge transporting layer of FIGS. 2 and 3 each is 3 μm to 50 μm, and preferably 5 μm to 20 μm.

In the photoreceptor of FIG. 1, the proportion of a charge transporting material to a binder in its photoreceptive layer is 10 to 150 wt%, and preferably 30 to 100 wt%, and the proportion of the compound represented by the general formula (I) or (II) to a binder is 1 to 150 wt%, and preferably 5 to 50 wt%.

In the photoreceptors of FIGS. 2 and 3, the proportion of a charge transporting material to a binder in their respective charge transporting layer is, in analogy with the photoreceptive layer of the photoreceptor in FIG. 1, 10 to 150 wt%, and preferably 30 to 100 wt%. Additionally, in any photoreceptors of FIGS. 1 to 3, plasticizers can be used together with binders. Moreover, on the occasion that the charge generating layer is made of a dispersion constituted with a charge generating material and a macromolecular binder, the macromolecular binder is preferably used in an amount not more than 10 parts by weight per 1 part by weight of the compound represented by the general formula (I) or (II).

In the electrophotographic photoreceptor of the present invention, a layer can be formed substantially of a compound represented by the general formula (I) or (II) by itself. When a layer is so formed, the charge generating layer can be formed by evaporating the compound represented by the general formula (I) or (II) onto a conductive support or a charge transporting layer, or by coating a coating composition prepared by dissolving or dispersing the compound represented by the general formula (I) or (II) in a solvent that can be removed by evaporation, and drying.

In the photoreceptor of the present invention, the conductive support which is conductive on at least its surface part may be in the form of known metal plates or foils, such as aluminium plate or foil, a metal (e.g., aluminium)-evaporated plastic film, and conductivity imparted paper.

Useful binders include condensation resins such as polyamide, polyurethane, polyester, epoxy resin, polyketone, polycarbonate and so on; vinyl polymers such as polyvinyl ketone, polystyrene, poly-N-vinylcarbazole and polyacrylamide. In addition to these resins, all resins having both insulating and abrasive properties can be employed.

Examples of useful plasticizers include biphenyl, biphenyl chloride, o-terphenyl, p-terphenyl, dibutyl phthalate, dimethylglycol phthalate, dioctyl phthalate, triphenylphosphoric acid, methylnaphthaline, benzophenone, chlorinated paraffin, polypropylene, polystyrene, dilaurylthiodipropionate, 3,5-dinitrosalicylic acid and various fluorohydrocarbons.

Examples of charge transporting materials which can be employed in the electrophotographic photoreceptors illustrated in FIGS. 1 to 3 include triphenylamine derivatives as disclosed in U.S. Pat. No. 3,567,450; Japanese Patent Publication No. 35702/74; West Germany Patent (DAS) No. 1,110,518; and so on: polyarylalkane derivatives as disclosed in U.S. Pat. No. 3,542,544; Japanese Patent Publication No. 555/70; Japanese Patent Application (OPI) No. 93224/76; and so on: pyrazoline derivatives as disclosed in Japanese Patent Applications (OPI) Nos. 72231/77 and 105537/74; Japanese Patent Publication No. 4188/77; and so on: hydrazone derivatives as disclosed in U.S. Pat. No. 3,717,462; Japanese Patent Applications (OPI) Nos. 59143/79 (corresponding to U.S. Pat. No. 4,150,987), 52063/80, 52064/80, 46760/80 and 85485/80; Japanese Patent Application No. 85495/80; and so on: and the like. These charge transporting materials can be used in combinations of two or more thereof according to circumstances.

In the present invention, a photosensitive wavelength region can be controlled by employing two or more of the compounds represented by the general formula (I) or (II) which have different photosensitive wavelength regions from one another. Further, it is also possible to control a photosensitive wavelength region by the combined use of one or more compounds represented by the general formula (I) or (II) and known sensitizer dyes.

In addition, in the thus obtained photoreceptor, an adhesive layer or barrier layer can be optionally provided between the conductive support and the photoreceptive layer. Materials for these layers include polyamide, nitrocellulose, aluminium oxide and so on, and the thickness of such a layer is preferably 1 μm or less.

The photoreceptors prepared in accordance with embodiments of the present invention have very high sensitivities and excellent durabilities. In addition, they can be obtained through simple procedures. Further, they have the advantage that the selectivity with respect to wavelengths required for electrophotographic photoreceptors when applied to a laser beam printer or display element is very high.

The photoreceptors of the present invention, when subjected to imagewise exposure, development with toner and etching processing, come to have another use, which is advantageous from the industrial point of view, as a printing plate (lithographic or relief plate) having high resolution, high durability and high sensitivity.

The present invention will now be illustrated in more detail by reference to the following preferred examples. However, the present invention should not be construed as being limited to the following examples, and some changes and modifications may be permitted unless they depart from the spirit and scope of the present invention. Additionally, in the following examples, all parts are by weight unless otherwise indicated.

EXAMPLE 1

2 Parts of the hydrazone compound having the following structural formula as a charge transporting material, and 5 parts of polycarbonate of bisphenol A were dissolved in 130 parts of dichloromethane.

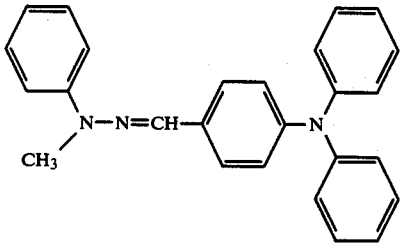

To the solution of the charge transporting material, 1 part of the compound (9) was added, and dissolved therein to prepare a coating solution for an electrophotographic photoreceptive layer.

This coating solution was coated on a conductive transparent support (which had an indium oxide-evaporated film on a 100 μm-thick polyethylene terephthalate film having $10^3\Omega$ of a surface resistance using a wire wound rod, and dried to form a single layer type electrophotographic photoreceptive layer having a dry thickness of about 7 μm.

The thus obtained photoreceptor was charged positively through +5 KV corona discharge using an electrostatic copying paper testing apparatus (Model SP-428, made by Kawaguchi Denki Seisakusho Co., Ltd.) and then, irradiated with light emitted from a 3000° K. of tungsten lamp placed at such a distance that an illumination intensity at the surface of the photoreceptor may become 30 lux. Thereunder, the time at which the surface potential was reduced to one-half its initial value was measured and thereby, a half decay exposure amount $E_{50}$ (lux·sec) was evaluated. The $E_{50}$ of this photoreceptor was 92 lux sec.

EXAMPLE 2

4 Parts of 4,4'-bis(diethylamino)-2,2'-dimethyltriphenylmethane as a charge transporting material, and 5 parts of polycarbonate of bisphenol A were dissolved in 130 parts of dichloromethane.

To this solution of the charge transfer material, 2 parts of the compound (9) was added, and dissolved therein to prepare a coating solution for an electrophotographic photoreceptive layer.

This coating solution was coated and dried in the same manner as in Example 1 to form a single layer type electrophotographic photoreceptive layer having a dry thickness of 7 μm.

The sensitivity of thus obtained photoreceptor was measured in the same manner as in Example 1, and the E value obtained was 160 lux sec.

EXAMPLES 3 TO 19

Photoreceptors having single layer type electrophotographic photoreceptive layers were prepared in the same manner as in Example 2 except that compounds set forth in the following Table 1 were employed respectively instead of the charge generating material used in Example 2.

The half decay exposure $E_{50}$ of each photoreceptor was measured in the same manner as in Example 2. The value obtained are listed up in Table 1.

TABLE 1

| Example | Number of Compound Represented by General Formula (I) or (II) | $E_{50}$ [lux · sec] |
|---|---|---|
| 3 | (5) | 5010 |
| 4 | (7) | 352 |
| 5 | (8) | 323 |
| 6 | (11) | 105 |
| 7 | (13) | 468 |
| 8 | (14) | 1090 |
| 9 | (15) | 151 |
| 10 | (16) | 460 |
| 11 | (18) | 289 |
| 12 | (19) | 3540 |
| 13 | (21) | 165 |
| 14 | (23) | 233 |
| 15 | (24) | 217 |
| 16 | (28) | 170 |
| 17 | (29) | 134 |
| 18 | (30) | 99 |
| 19 | (33) | 504 |

EXAMPLE 20

The compound (17) was evaporated onto a 100 μm-thick, grained aluminium plate for 15 minutes under conditions that pressure inside the evaporation system was $2\times10^{-5}$ Torr and an evaporation temperature was 300° C. and thereby, a charge generating layer having a thickness of 0.5 μm was provided.

Next, 5 parts of 4,4'-bis(diethylamino)-2,2'-dimethyltriphenylmethane as a charge transporting material, and 4 parts of polycarbonate of bisphenol A were dissolved in 100 parts of dichloromethane. The solution was coated on the charge generating layer using a rotational coating process, and dried to form an electrophotographic photoreceptor having an integral unit type of electrophotographic photoreceptive layer having a thickness of 7 μm.

The sensitivity of the thus obtained photoreceptor was measured in the same manner as in Example 1, and the $E_{50}$ value obtained was 350 lux·sec.

The electrophotographic photoreceptor having the electrophotoreceptive layer contains no charge generating material has low sensitivity to show the order of ten thousands (lux.sec) of $E_{50}$ value. Thus, it is apparent that the photoreceptor of the present invention has an unexpectable superiority in sensitivity.

While the invention has been described in detail and with reference to specific embodiment thereof, it will be apparent to one skilled in the art that various changes and modifications can be made therein without departing from the spirit and scope thereof.

What is claimed is:

1. An electrophotographic photoreceptor which has an electrophotographic photoreceptive layer containing a charge generating material and a charge transporting material, said charge generating material being a compound of the following general formula (I) or (II):

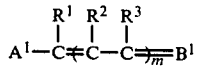

(I)

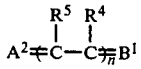

(II)

wherein:

(i) m is 0, and n is 0, 1, or 2, (ii) $R^1$ to $R^5$ may be the same or different, and each is a hydrogen atom, an alkyl group, an aralkyl group, an aryl group or a monovalent group produced by removing one hydrogen atom from a heterocyclic ring, (iii) $A^1$ is substituted phenyl group, a monovalent group produced by removing one hydrogen atom from a monocyclic 5-membered hetero-ring, a condensed 5-membered hetero-ring or a condensed 6-membered hetero-ring, which have the following structural formulae, respectively;

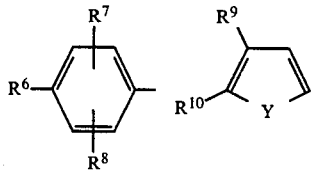

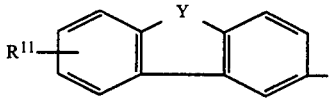

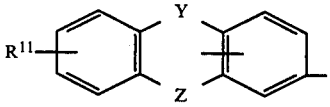

wherein $R^6$ is an alkoxy group, an aralkyloxy group or a substituted amino group of the formula

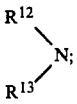

$R^{12}$ and $R^{13}$ each is a substituted or non-substituted alkyl group or a substituted or non-substituted phenyl group, or they may combine with each other and form a nitrogen-containing hetero-ring, and they may be the same or different; $R^7$ and $R^8$ may be the same or different, and each is a hydrogen atom, a halogen atom, an alkyl group or a lower alkoxy group; Y and Z are S, O or N—$R^{14}$, wherein $R^{14}$ is an alkyl group having 1 to 4 carbon atoms, and they may be the same or different; $R^9$ and $R^{10}$ may be the same or different, and each is a hydrogen atom, an alkyl group or an alkoxy group, or they may combine with each other and form a benzene ring or a naphthalene ring; and $R^{11}$ is a hydrogen atom, an alkyl group, an alkoxy group, an aryloxy group, an acyl group, an alkoxycarcarbonyl group, an aryloxycarbonyl group, a halogen atom, a monoalkylamino group, a dialkylamino group, an amido group or a nitro group, which groups each may be substituted;

(iv) $A^2$ is a divalent group produced by removing two hydrogen atoms attached to the same carbon from a heterocyclic ring selected from a group consisting of imidazoles, 3H-indoles, thiazoles, benzothiazoles, naphthothiazoles, thianaphthenoo-7',6',4,5-thiazoles, oxazoles, benzoxazoles, naphthooxazoles, selenazoles, benzoselenazoles, naphthoselenazoles, thiazolines, quinolines, isoquinolines, benzimidazoles and pyridines, and (v) $B^1$ is a divalent group selected from substituents of the following structural formulae;

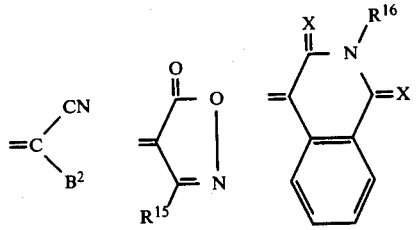

wherein $R^{15}$ and $R^{16}$ each is an alkyl group or an aryl group; X is an oxygen atom or a sulfur atom; and $B^2$ is a cyano group, a carboxyl group, an alkoxycarbonyl group, an aryloxycarbonyl group, an alkylsulfonyl group, an alkylcarbonyl group, an arylcarbonyl group, a nitro group, a nitro-substituted aryl group, a sulfo group, a trifluoromethylsulfonyl group, a carbamoyl group, an alkylcarbamoyl group, an arylcarbamoyl group or an acyl group whose carbonyl group is attached to a monovalent group produced by removing one hydrogen atom from a heterocyclic ring, and said charge transporting material is at least one compound selected from the group consisting of triphenylamine derivatives, polyarylalkane derivatives, pyrazoline derivatives and hydrazone derivatives.

2. The electrophotographic photoreceptor described in claim 1, wherein said electrophotographic photoreceptive layer is a single layer containing both said charge generating material and said charge transporting material.

3. The electrophotographic photoreceptor described in claim 1, wherein said electrophotographic photoreceptive layer is comprised of two layers, a first layer being a charge generating layer containing said charge generating material, and a second layer being a charge transporting layer containing said charge transporting material.

4. An electrophotographic photoreceptor as claimed in claim 2, wherein the electrophotographic photoreceptive layer has a thickness of from 3 μm to 50 μm.

5. An electrophotographic photoreceptor as claimed in claim 4, wherein the thickness of the electrophotographic photoreceptive layer is 5 μm to 20 μm.

6. An electrophotographic photoreceptor as claimed in claim 3, wherein the charge-generating layer has a thickness of 5 μm or less.

7. An electrophotographic photoreceptor as claimed in claim 6, wherein the charge-generating layer has a thickness of 2 μm or less.

8. An electrophotographic photoreceptor as claimed in claim 3, wherein the charge transporting layer has a thickness of 3 μm to 50 μm.

9. An electrophotographic photoreceptor as claimed in claim 8, wherein the thickness of the charge transporting layer is from 5 μm to 20 μm.

10. An electrophotographic photoreceptor as claimed in claim 2, wherein the charge generating material is dispersed homogeneously or heterogeneously in a charge transporting medium comprising a charge transporting material and a binder and wherein the charge transporting material is from 10 to 150 weight percent with respect to the binder and further wherein the compound represented by the general formula (I) or (II) is contained in an amount of 1 to 150 weight percent with respect to the binder.

11. An electrophotographic photoreceptor as claimed in claim 10, wherein the charge transporting material is contained in an amount of 30 to 100 weight percent with respect to the weight of the binder and the compound represented by the general formula (I) or (II) is contained in an amount of 5 to 50 weight percent with respect to the binder.

12. An electrophotographic photoreceptor as claimed in claim 3, wherein the charge transporting material is contained in a binder and said charge transporting material is present in an amount of 10 to 150 weight percent based on the weight of the binder.

13. An electrophotographic photoreceptor as claimed in claim 12, wherein the charge transporting material is contained in an amount of 30 to 100 weight percent based on the weight of the binder.

14. An electrophotographic photoreceptor as claimed in claim 3, wherein the charge generating layer comprises the charge generating material dispersed in the binder present in an amount of 10 parts by weight or less per 1 part by weight of the compound represented by the general formula (I) or (II).

15. An electrophotographic photoreceptor as claimed in any of claims 1, 2, or 3, wherein a plurality of compounds represented by the general formula (I) or (II) are present.

16. An electrophotographic photoreceptor as claimed in any of claims 1, 2, or 3, further comprising sensitizer dyes.

17. An electrophotographic photoreceptor as claimed in claim 1, further comprising an adhesive layer or barrier layer positioned between the photoreceptive layer and the conductive surface.

18. An electrophotographic photoreceptor as claimed in claim 17, wherein the adhesive layer or the barrier layer has a thickness of 1 μm or less.

19. An electrophotographic photoreceptor as claimed in claim 1, wherein said charge transporting material is the triphenylamine derivatives.

20. An electrophotographic photoreceptor as claimed in claim 1, wherein said charge transporting material is the polyarylalkane derivatives.

21. An electrophotographic photoreceptor as claimed in claim 1, wherein said charge transporting material is the pyrazoline derivatives.

22. An electrophotographic photoreceptor as claimed in claim 1, wherein said charge transporting material is the hydrazone derivatives.

* * * * *